United States Patent [19]

Takagaki

[11] Patent Number: 5,065,841

[45] Date of Patent: Nov. 19, 1991

[54] LUBRICATING SYSTEM FOR A VERTICAL SHAFT ENGINE

[75] Inventor: Katsumi Takagaki, Urawa, Japan

[73] Assignee: Fuji Jukogyo Kabushiki Kaisha, Tokyo, Japan

[21] Appl. No.: 577,252

[22] Filed: Aug. 31, 1990

[30] Foreign Application Priority Data

Sep. 27, 1989 [JP] Japan ..... 1-113945[U]

[51] Int. Cl.[5] ..... F01M 1/04

[52] U.S. Cl. ..... 184/6.18; 184/6.5; 123/192 B; 123/196 R

[58] Field of Search ..... 184/6.18, 6.12, 6.5; 123/196 R, 196 W, 192 B

[56] References Cited

U.S. PATENT DOCUMENTS

| | | | |
|---|---|---|---|
| 2,607,332 | 8/1952 | Bosma | 123/196 W |
| 4,028,963 | 6/1977 | Nakamura et al. | 128/192 B |
| 4,480,607 | 11/1984 | Tsai et al. | 123/192 B |
| 4,664,228 | 5/1987 | Hashigaki et al. | 184/6.18 |

FOREIGN PATENT DOCUMENTS 62-105312 7/1987 Japan .

*Primary Examiner*—Ira S. Lazarus
*Assistant Examiner*—Alan B. Cariaso
*Attorney, Agent, or Firm*—Martin A. Farber

[57] ABSTRACT

A balancer shaft is disposed parallel to a crankshaft, and rotated at the same speed as the crankshaft. An oil pump is provided below the balancer shaft and is driven by the balancer shaft. Oil passages are provided for supplying oil from the oil pump passing through a passage formed in the balancer shaft. The oil is ejected to a big end of a connecting rod.

6 Claims, 1 Drawing Sheet

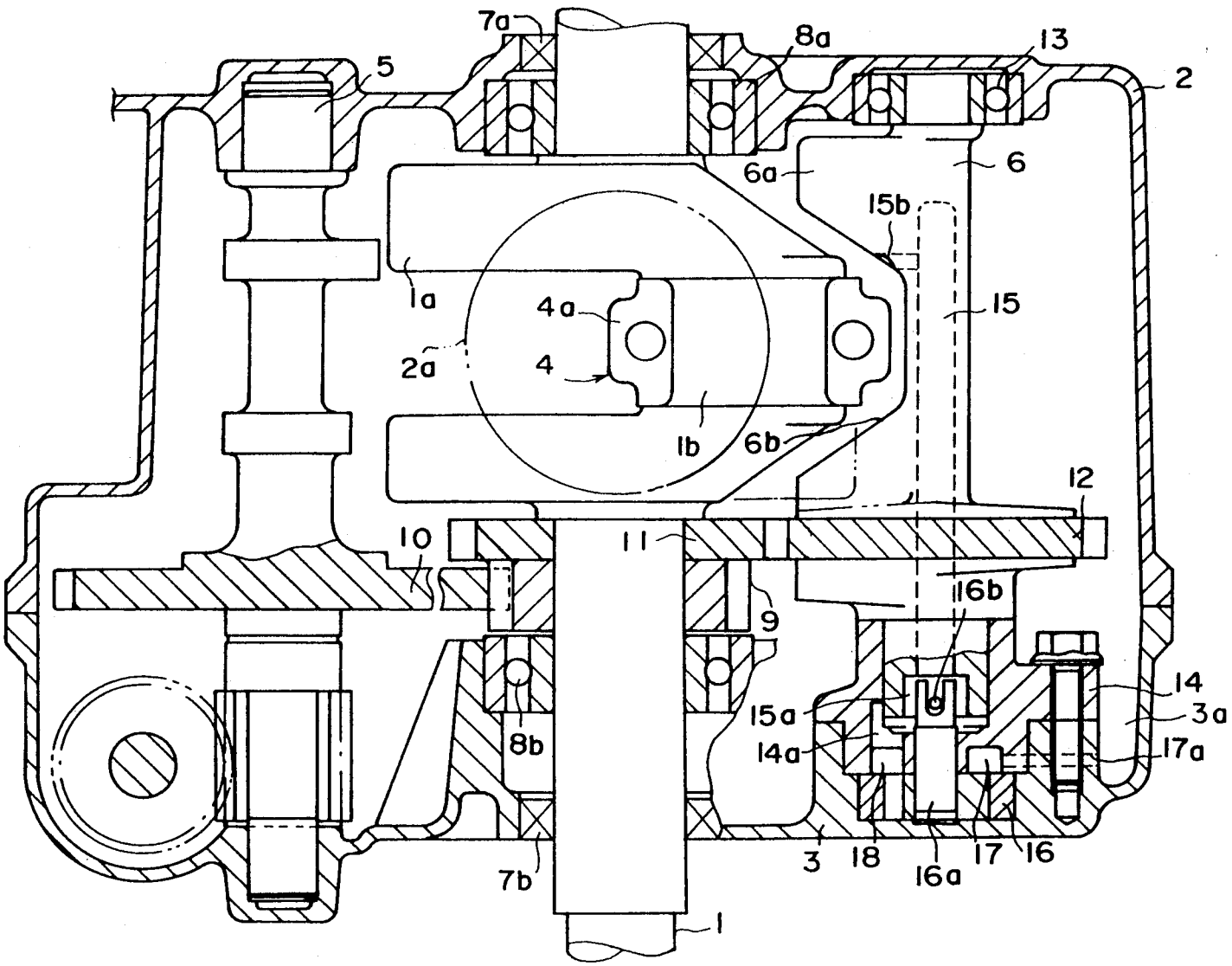
2
13
8a
7a
5
6
6a
15
15b
1a
1b
2a
4
4a
6b
12
11
10
9
8b
7b
1
14
3a
17a
16
17
16a
16b
18
3
14a
15a

LUBRICATING SYSTEM FOR A VERTICAL SHAFT ENGINE

BACKGROUND OF THE INVENTION

The present invention relates to a lubricating system for an engine having a vertical shaft, and more particularly to a system for lubricating a big end of a crankshaft of the engine.

Generally, a vertical shaft engine can not use an ordinary lubricating system where oil in an oil reservoir provided in a crankcase is scooped up with a crankshaft for lubricating the engine. Consequently, the vertical shaft engine is employed with a lubricating system having an oil pump. Japanese Utility Model Application Laid-Open 62-105312 discloses a lubricating system for the vertical shaft engine in which an oil pump is provided in an end of a balancer shaft. An outlet port of the oil pump is communicated with openings of an oil supply passage formed around a lower portion of the crankshaft through an oil passage provided in the crankshaft. The oil passes to the big end passing through the passages.

The oil passage in the crankshaft is formed by combining several bores drilled in the crankshaft. Consequently, several manufacturing steps are necessary for forming the oil passage. Further, an end of the oil passage must be closed by a plug, which increases the manufacturing cost.

In another lubricating system in which lubricating oil is dropped only to bearings from openings. By this system other particular portions such as a magneto, cam bearings, pistons and tappets are not sufficiently lubricated.

SUMMARY OF THE INVENTION

The object of the present invention is to provide a lubricating system for a vertical shaft engine which may improve lubricating efficiency for various parts of the engine.

According to the present invention, there is provided a lubricating system for a vertical shaft engine having a vertical crankshaft, a balancer shaft parallel with the crankshaft, at least one connecting rod having a big end rotatably mounted on a crankpin of the crankshaft, and gears provided between the crankshaft and the balancer shaft for rotating the balancer shaft.

The system comprises an oil passage vertically provided in a center portion of the balancer shaft between the pump and an upper portion of a counterweight on the balancer shaft. An ejecting port is horizontally formed in the counterweight and perpendicularly communicates with the oil passage for supplying the lubricating oil to the big end of the connecting rod. The counterweight is formed with a recessed portion at a center portion thereof providing space in which the crankpin of the crankshaft is positioned such that the big end avoids interfering with the counterweight when the crankshaft rotates. The ejecting port is arranged at an upper portion of the recessed portion closely approaching an upper side of the big end and is synchronized by timing both rotations of the crankshaft and of the balancer shaft so as to cause the ejecting port to coincide with the upper side of the big end for properly lubricating the big end with a simple structure.

The other objects and features of the present invention will become understood from the following description with reference to the accompanying drawings

BRIEF DESCRIPTION OF THE DRAWING

The sole figure is a sectional view showing a part of a vertical shaft engine having a lubricating system according to the present invention.

DETAILED DESCRIPTION OF THE PREFERRED EMBODIMENT

Referring to the drawing, a vertical shaft engine has a cylinder 2*a*, a crankcase 2 and a main bearing cover 3 acting as a part of the crankcase 2. A vertical crankshaft 1 is rotatably supported by a bearing 8*a* and a bearing 8*b* in the crankcase 2 and the main bearing cover 3 respectively. Oil seals 7*a* and 7*b* are provided in the crankcase 2 and the main bearing cover 3, respectively. The crankshaft 1 has a pair of webs 1*a* and a crankpin 1*b* rotatably connected to a connecting rod 4. Drive gears 9 and 11 are securely mounted on the crankshaft 1.

A camshaft 5 is rotatably supported in the crankcase 2 and the main bearing cover 3, parallel to the crankshaft 1. A driven gear 10 formed on the camshaft 5 meshes with the drive gear 9 of the crankshaft 1. The camshaft 5 rotates once when the crankshaft 1 rotates twice.

A balancer shaft 6 parallel to the crankshaft 1 is rotatably supported in the crankcase 2 by bearings 13 and 14, the latter of which is secured to the main bearing cover 3 with bolts. The balancer shaft 6 has a driven gear 12 meshed with the drive gear 11 of the crankshaft 1 and counterweights 6*a* for absorbing the fluctuation of rotating speed of the crankshaft 1. The balancer shaft 6 rotates at the same rotating speed as the crankshaft 1.

The balancer shaft 6 has an oil gallery 15 formed therein extending in its axial direction. The oil gallery has an opening 15*a* at a lower end and a radially ejecting port 15*b* communicated with the oil gallery 15 for ejecting oil. The ejecting port 15*b* is opens toward a big end 4*a* of the connecting rod 4 rotatably mounted on the crank pin 1*b* of the crankshaft 1.

Since the rotating speed of the balancer shaft 6 is equal to the speed of the crankshaft 1, the oil from the ejecting port 15*b* may be uniformly distributed to the crankshaft 1. The position of the ejecting port 15*b* is determined such that the distance between the big end 4*a* of the connecting rod 4 and the ejecting port 15*b* becomes small.

An oil pump 16 is provided in the main bearing cover 3 in the lower portion of the bearing 14. A drive shaft 16*a* of the oil pump 16 is coaxial with the balancer shaft 6 and secured to the lower end of the balancer shaft 6 with a pin 16*b* so that the drive shaft 16*a* is driven by the balancer shaft 6. The oil pump 16 has an inlet port 17 and an outlet port 18 formed in the bearing 14. The inlet port 17 is communicated with an oil reservoir 3*a* formed in the main bearing cover 3 through an oil supply passage 17*a*. The outlet port 18 is communicated with the opening 15*a* of the balancer shaft 6 through a chamber 14*a* formed in the bearing 14. The lubricating oil in the oil reservoir 3*a* is drawn into the oil pump 16 through the oil supply passage 17*a* and the inlet port 17. The pressurized oil is discharged from the outlet port 18 and passages to the oil gallery 15 of the balancer shaft 6 through the chamber 14*a* and the opening 15*a*.

The lubricating oil in the oil gallery 15 is ejected from the ejecting port 15*b*. A portion of the oil is ejected to the big end 4a of the connecting rod 4 at every single rotation of the balancer shaft 6. The remaining oil is splashed by the balancer shaft 6 in the crankcase 2 by centrifugal force due to rotation of the balancer shaft 6. Thus, various parts of the engine are lubricated.

The ejecting port 15b is horizontally formed in the counterweight 6a and substantially perpendicularly communicates with the oil passage 15 for supplying the lubricating oil to the big end 4a of the connecting rod 4. The counterweight 6a is formed with a recessed portion 6b at a center portion thereof providing space in which the crankpin 1b of the crankshaft 1 is positioned such that the big end 4a avoids interfering with the counterweight 6a when the crankshaft 1 rotates. The ejecting port 15b is located at an upper portion of the recessed portion closely approaching an upper side of the big end 4a and is synchronized by timing both rotation of the crankshaft 1 and of the balancer shaft 6 so as to cause the ejecting port 15b to substantially coincide with the upper side of the big end 4a, thereby enabling proper lubrication of the big end of the connecting rod 4 with a simple structure.

In operation, when the engine starts, the balancer shaft 6 is rotated by the crankshaft 1 through the drive gear 11 and the driven gear 12 and the oil pump 16 is driven by the balancer shaft 6.

The oil discharged from the outlet port 18 of the oil pump 16 is supplied to the oil gallery 15 of the balancer shaft 6 through the chamber 14a and is the opening 15a and ejected from the ejecting port 15b.

Since the crankshaft 1 and the balancer shaft 6 are rotated at the same rotating speed, a portion of the oil is ejected on the big end 4a of the connecting rod 4 at every single rotation of the balancer shaft 6. The remaining oil is splashed in the crankcase 2 in accordance with the rotation of the balancer shaft 6.

Consequently, the lubricating oil lubricates the connecting rod 4. The remaining oil and the oil adhering on the webs 1a of the crankshaft 1 are splashed in the crankcase 2 by the centrifugal force in order to lubricate bearings, pistons and tappets of the engine.

In accordance with the present invention, the outlet port 18 of the oil pump 16 driven by the balancer shaft 6 communicates with the opening 15a of the oil gallery 15 formed in the balancer shaft 6. The lubricating oil discharged from the oil pump 16 is supplied to the oil gallery and ejected from the ejecting port 15b of the balancer shaft onto the big end 4a of the connecting rod 4. Thus, it is not necessary to provide complicated oil passages in the crankcase and the crankshaft. The system can be easily manufactured, thereby reducing the manufacturing cost.

Since the balancer shaft 6 and the crankshaft 1 are rotated at the same rotating speed, it is possible to synchronize the rotation of the big end 4a of the connecting rod 4 with that of the outlet port 15b of the balancer shaft 6 and to keep the shortest distance therebetween during the rotation, thereby enabling the proper lubrication.

Furthermore, the lubricating oil splashes by the centrifugal force due to the rotation of the balancer shaft so that lubricating efficiency for various parts of the engine, such as bearings of the camshaft and the crankshaft pistons and tappets can be improved.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In a lubricating system for a vertical shaft engine having a crankcase housing a camshaft and storing lubricating oil, a vertical crankshaft rotatably mounted in the crankcase and comprising a crankpin and a pair of crank webs, a connecting rod jounaled by said crankpin at a big end of the connecting rod, a balancer shaft parallel to said vertical crankshaft and rotatably mounted in said crankcase at a side of said crankshaft opposite from said camshaft, a counterweight on said balancer shaft for counterbalancing the mass of said crank webs, an oil pump coaxially mounted under said balancer shaft in said crankcase, so as to be driven by the balancer shaft the improvement of said system which comprises:

an oil passage vertically formed in a center portion of said balancer shaft between said pump and an upper portion of said counterweight and communicating with said pump;

an ejecting port substantially horizontally formed in said counterweight and perpendicularly communicating with said oil passage for supplying the lubricating oil to said big end of the connecting rod;

said counterweight having a recessed portion at a center portion thereof in which recessed portion the crankpin is expendable such that said being end of the connecting rod avoids interfering with said counterweight when said crankshaft rotates; and said ejecting port being disposed at an upper portion of said recessed portion adjacent an upper portion of the crankpin for closely approaching an upper side of said big end and being synchronized by timing both rotation of said crankshaft and of said balancer shaft so as to cause said ejecting port to substantially coincide with said upper side of said big end, whereby said big end is properly lubricated with a simple structure.

2. The system according to claim 1, wherein said balancer shaft is drivingly connected to a drive shaft of said oil pump.

3. The system according to claim 1, further comprising means or driving said balancer shaft at the same speed of rotation as said crankshaft.

4. The system according to claim 3, wherein said means comprises a drive gear mounted on said crankshaft, and a driven gear mounted on said balancer shaft and meshing with said drive gear.

5. The system according to claim 1, further comprising means for synchronizing rotation of said big end and of said balancer shaft so as to keep shortest distance of said ejecting port form said big end during said rotation and wherein during said rotation said distance becomes small.

6. The system according to claim 1, wherein said recessed portion is formed by a vertical surface of said balancer shaft and inclined surfaces of said counterweight, and said ejecting port extends through an upper one of said inclined surfaces.

* * * * *